US005943904A

United States Patent [19]

Kramer

[11] Patent Number: 5,943,904

[45] Date of Patent: Aug. 31, 1999

[54] THREAD-ROLLING DIE

[75] Inventor: Rodney M. Kramer, Rockford, Ill.

[73] Assignee: Ingersoll Cutting Tool Company, Rockford, Ill.

[21] Appl. No.: 08/399,086

[22] Filed: Mar. 8, 1995

[51] Int. Cl.[6] ..... B21H 3/06

[52] U.S. Cl. ..... 72/469; 72/88

[58] Field of Search ..... 72/88, 469, 90, 72/103

[56] References Cited

U.S. PATENT DOCUMENTS

| | | | |
|---|---|---|---|
| 2,303,224 | 11/1942 | Olson | 72/469 |
| 3,889,516 | 6/1975 | Yankee et al. | 72/469 |
| 4,034,586 | 7/1977 | Corrette | 72/88 |
| 4,408,418 | 10/1983 | Corrette . | |
| 4,411,147 | 10/1983 | Capuano | 72/88 |
| 4,546,639 | 10/1985 | Corrette | 72/469 |
| 4,561,277 | 12/1985 | Taubert et al. | 72/88 |
| 4,573,376 | 3/1986 | Corrette . | |
| 4,576,033 | 3/1986 | Corrette | 72/469 |
| 4,631,947 | 12/1986 | Corrette | 72/88 |
| 4,655,073 | 4/1987 | Yamamoto | 72/469 |
| 4,666,348 | 5/1987 | Corrette | 72/88 |
| 4,713,954 | 12/1987 | Corrette | 72/88 |
| 4,716,751 | 1/1988 | Wozniak | 72/88 |
| 4,735,537 | 4/1988 | Rath | 72/469 |
| 4,793,219 | 12/1988 | Wozniak | 72/469 |
| 4,798,070 | 1/1989 | Hlavaty | 72/88 |
| 4,862,718 | 9/1989 | LaCroix | 72/88 |
| 5,182,937 | 2/1993 | Dickson | 72/469 |
| 5,243,843 | 9/1993 | Dickson | 72/88 |

FOREIGN PATENT DOCUMENTS

| | | | |
|---|---|---|---|
| 184441 | 9/1985 | Japan | 72/88 |

*Primary Examiner*—Daniel C. Crane
*Attorney, Agent, or Firm*—Fitch, Even, Tabin & Flannery

[57] ABSTRACT

The specification and drawings describe and show a thread-rolling die whose thread-forming lands are modified at their points of emergence along the side edge of die so that the crest of the ramp formed by the emerging end of the land remains parallel to the crest of the adjacent land.

6 Claims, 2 Drawing Sheets

THREAD-ROLLING DIE

This invention relates a method and to tooling for rolling threads on the shanks of studs, screws, bolts, and the like, and more particularly to improvements in thread-rolling dies and their usage to extend the life of such dies by reconfiguring the thread lands at their points of emergence from the die to eliminate the chipping out of the edge of the die.

BACKGROUND OF THE INVENTION

The process of rolling threads on a metal shank consists essentially of placing the shank in the path of the relative movement of two coacting dies which compress and roll the shank between their striated facing surfaces to impress a helical thread form into the surface of the shank as the two dies pass each other with decreasing clearance between their faces. The surfaces of the dies may be flat and the path of their relative movement linear and reciprocating, or the surfaces of the coacting dies may be arcuate and their relative movement circular and continuous.

In either case, the facing surfaces of the dies are striated with alternate lands and grooves having a cross-sectional configuration complementary to the thread form desired on the rolled shank, and the lands and grooves are inclined at the desired lead or helix angle to the direction of relative movement of the two dies, the leads of the two dies being of equal but opposite inclination.

Coactive surfaces long enough in the direction of relative movement to cold forge the surface of the shank into a helical thread will typically have multiple thread starts where successive lands emerge from the edge of the die one shank circumference distant from one other along that edge. The emerging die land at that point is weak and sharp, a condition which has typically been relieved in part by chamfering the edge of the die along which the thread-forming lands emerge.

While this measure eliminates the knife-edge of the emerging land for the protection of those who handle the dies, it has not cured the lateral weakness of the emerging land, with the result that die failures regularly occur by the chipping out of the emerging end of the die land, and frequently also result in the chipping out of the edge of the die block, sometimes to surprising depths. This mode of failure occurs in high speed steel as well as in cemented carbide die materials and can severely limit the life of the die by destroying its ability to produce threads to required specifications.

SUMMARY OF THE INVENTION

Analysis of the configuration of the emerging die land of a thread-rolling die that has been chamfered as above described reveals that the ramp formed by the decreasing height of the land at its emerging end is asymmetrical, i.e., the crest of the ramp converges toward the adjacent land, weakening the ramp against the side thrust of the shank metal resisting forced cold flow into the groove between the ramp and the adjacent land of the die.

This inherent weakness of the conventional thread-rolling die has been eliminated by the land configuration of the invention, which maintains the parallelism of the crest of the ramp of the diminishing emerging die land with the crest of the adjacent die land. This is achieved by beveling the interior flank of the diminishing die land at the appropriate angle, which, in the case of a symmetrical thread form, would be the angle at which the exterior flank is beveled, i.e., the bevel angle imposed upon the adjacent edge of the die.

BRIEF DESCRIPTION OF THE DRAWINGS

The invention will be described with reference to the accompanying drawings, in which.

DESCRIPTION OF THE INVENTION SETTING

Figure 8:
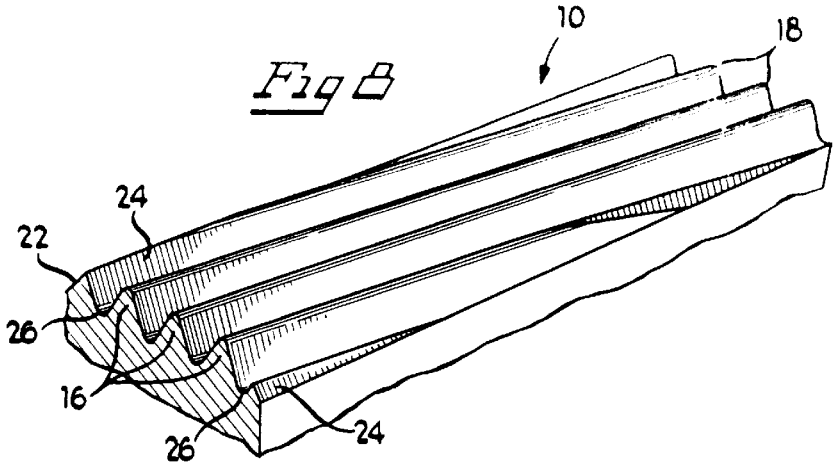
FIG. 8 is an isometric view of the edge of the die fragment of FIG. 3.
Figure 1:
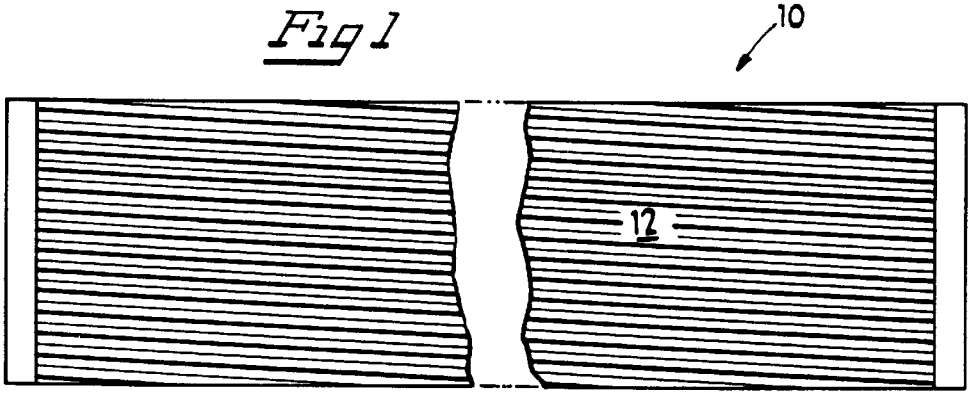
FIG. 1 is a foreshortened diagrammatic elevation of the striated face of a linear thread-rolling die.
Figure 2:
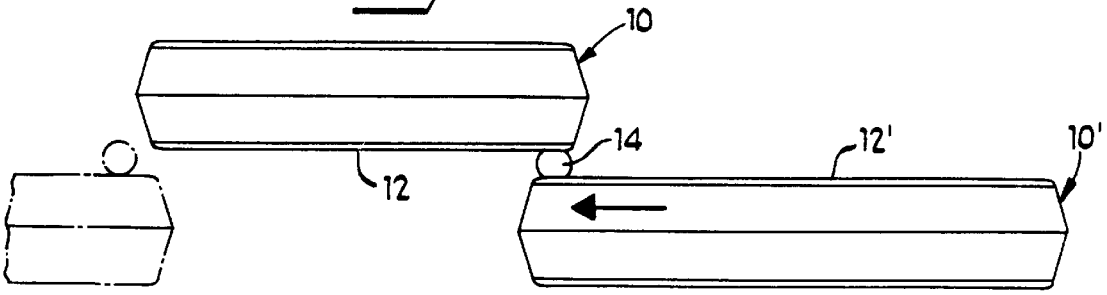
FIG. 2 is a diagrammatic plan view of a pair of linear dies poised to roll a thread on the surface of a cylindrical shank, and showing by broken lines their relative positions where they discharge the threaded shank.

A thread-rolling die 10 of the kind to which the invention is readily applicable is shown diagrammatically in FIG. 1. Its active face 12 is striated by lands and grooves complementary to the desired thread to be cold-formed by metal displacement along the surface of a cylindrical shank 14 as the shank is rolled between the faces of a pair of matched dies 10 and 10'; as indicated by FIG. 2.

The dies 10 and 10' are essentially rectangular blocks of tool material, typically high speed steel or a so-called "hard metal" such as a cemented carbide. The striated active face of the die block 10 in FIG. 1 may be slightly wider than double the length of the shank to be thread-rolled, so that each die can be turned end-for-end to present a fresh die face to the workpiece.

Similarly, the opposite face of the die block 10 may likewise be machined to present an identical striated face, indexable in the same manner, to provide four serviceable die surfaces on each block.

The same may also be true of the die block 10', so that, in effect, each die block set provides four die sets. To accommodate the indexing of the die blocks from face to face, the ends of the die blocks 10 and 10' are double tapered to accommodate the usual wedge clamps to secure them in their respective seats.

As illustrated, the die block 10 is seated in the fixed frame of the thread-rolling machine, and the die block 10' in the reciprocating carriage of the machine, the dies being aligned in height and longitudinally mutually to engage the same thread path being forged upon the shank of the workpiece.

The workpiece shank is presented to the entry of the space between the two coacting dies at one end of that space, by feeding mechanism not shown, to be gripped between the active faces of the two dies as they move linearly relative to each other in the direction of the arrow on the die block 10' in FIG. 2.

For the rolling-on entry of the blank shank 14 into the space between the dies, and the rolling off of the threaded shank at the end of the threading operation, to fall by gravity, typically, into a suitable collector, the movable die 10' is made longer than the fixed die 10 by approximately two circumferences of the workpiece.

As is well understood by those skilled in the art, the space between the coacting die faces 12 and 12' diminishes as the workpiece is rolled from the entry end to the finished end of the fixed die 10. This may be achieved by adjustment of the die block seats of one or both of the dies.

THE PREFERRED EMBODIMENT

As shown particularly in FIGS. 3 to 7 inclusive, the invention contemplates a further re-shaping of each land 16 of the striated face of the die block where the land emerges at the side edge of the die.

Figure 3:
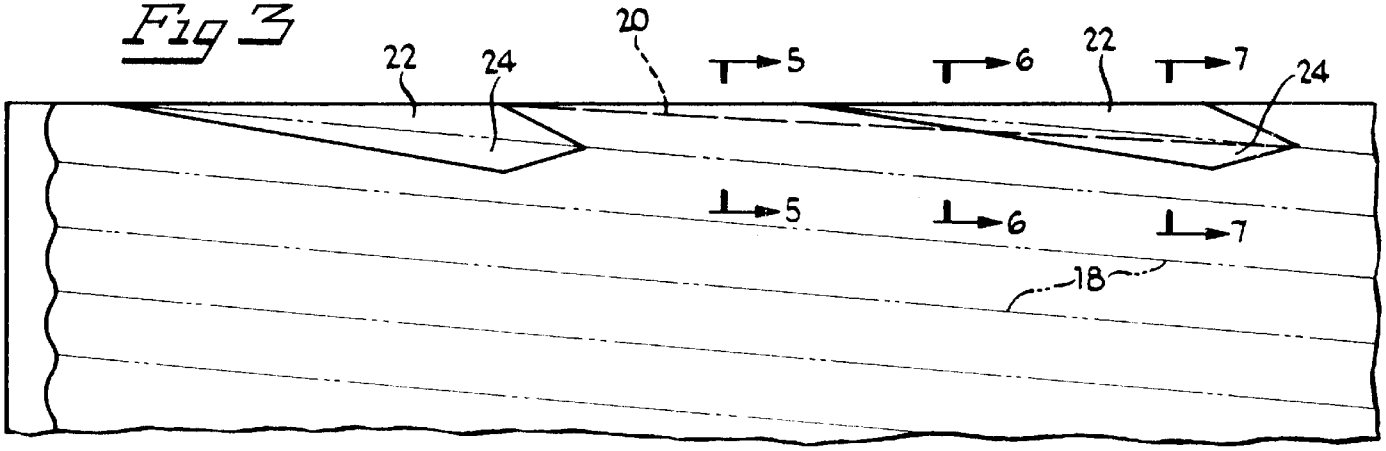
FIG. 3 is a much magnified, fragmentary elevational view of the upper left hand corner of the die of FIG. 1, illustrating two emerging die lands as modified in accordance with the invention.
Figure 4:
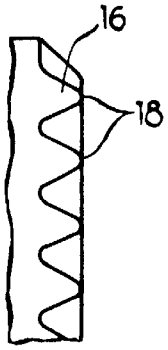
FIG. 4 is an end view of the die fragment of FIG. 3.
Figure 7:
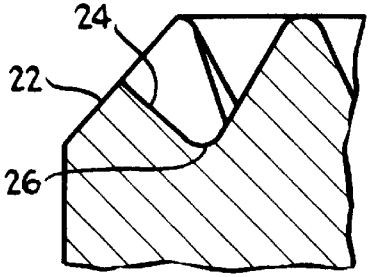
FIGS. 5, 6, and 7 are fragmentary sectional views taken, respectfully, on the section lines 5—5, 6—6, and 7—7 of FIG. 3.
Figure 6:
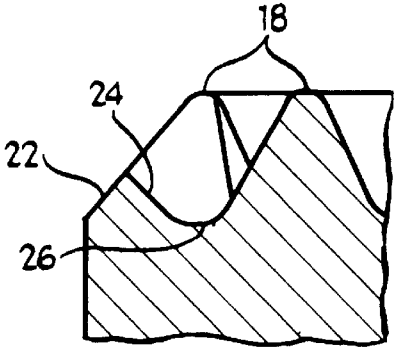
Figure 5:
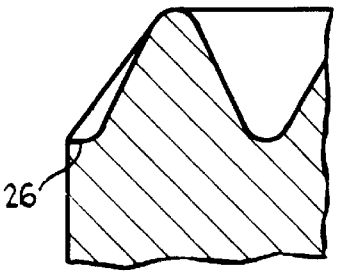

In FIG. 3, the crests 18 of the lands 16 of the die face are represented by dot dash lines, while FIGS. 4 to 7 reveal that the thread form chosen to illustrate the invention is a conventional symmetrical thread, i.e., one having equal flank angles which in end view (FIG. 4) and section view (FIGS. 5 to 7) appear as isosceles triangles. It should therefore be noted preliminarily that the invention is not limited to dies for rolling conventional symmetrical threads, but is applicable as well to asymmetrical thread forms, i.e., those having unequal flank angles.

In the conventional die, whose side edges have simply been chamfered, i.e., beveled at 45°, the crest of the emerging end of each die land converges toward the adjacent land as the ramp formed by the chamfer decreases in height toward the root between the lands. This convergence is shown by the broken line 20 in FIG. 3, representing the condition of the die before its further preparation in accordance with the invention.

This convergence of the crest of the diminishing ramp portion of the emerging land weakens the emerging land against the lateral thrust of the metal being formed into the thread on the surface of the shank, and frequently results in the chipping out of the emerging land, not infrequently leaving a crater extending fairly deeply along the side surface of the die block. Such failures typically begin with the emerging land closest the shank-entering end of the die, and occur progressively along succeeding emerging lands, until the die can no longer produce threads to specification, and must be indexed or replaced.

Depending upon the service, the cost in down-time of the machine for die renewal, and the cost of short-lived dies, can be excessive. In one case of rolling a 60° thread on a special automotive part at 7/16 in. pitch diameter with a pitch of 14 per inch on a shank having a hardness of 40 Rockwell C, the high speed steel die required indexing or replacement after producing only 6,500 pieces, with the result that the machine was out of production for seventy percent of the time for setup, i.e., while the indexed dies, and eventually the replaced dies, were being installed and the setup tested.

The solution to this problem provided by the invention is the further shaping of the emerging end of the die land so that the crest of the diminishing land maintains its parallelism with the crest of the adjacent land. In practical terms, this means that the outer facet 22 of the diminishing land produced by the chamfering bevel at the side edges of the die block must be matched by a facet 24 of equal angle on the inside, in the case of a symmetrical thread, in order to maintain that symmetry as the ramp of the emerging land descends gradually to the root 26 between the lands.

In the case illustrated in FIGS. 3 to 7 inclusive, the side edges of the block are beveled at 45°, and so, therefore, are the inner facets 24. That bevel angle is not of particular significance in and of itself and could, for example, be the flank angle of the land, typically 60°. The important consideration is the maintenance of the parallelism of the crest of the diminishing land with that of the adjacent land, which, in the case of an asymmetric thread earlier referred to, can be maintained by maintaining the respective land-flank angles in the diminishing ramp portion of the land.

With the application of the invention to the specific dies earlier referred to, the life of the high speed steel dies has been dramatically increased, i.e., they continue to produce the threaded part to specification through over 67,000 pieces before normal wear of the active faces of the dies mandates replacement, that wear being evidenced as the pitting of the flanks of the lands due to the work-hardening of the die surfaces, the chipping out of the emerging ends of the lands having been eliminated.

This order-of-magnitude improvement in the life of conventional high speed steel thread-rolling dies obviously recommends itself to those skilled in the art, for the relatively minor structural re-configuration by which it has been accomplished can be carried out by a tool maker of average skill on a conventional Bridgeport mill or jig grinder.

The features of the invention believed patentable are set forth in the appended claims.

What is claimed is:

1. In a die for rolling threads on a shank of circular cross section, said die comprising a block of tool material having a shank-engaging face striated with multiple grooves and lands complementary to the thread to be produced upon said shank, said grooves and lands being disposed at the thread lead angle with respect to the direction of movement of said die block relative to said shank in the rolling of the thread and emerging from the die block along an edge thereof in multiple thread starts sufficient with the coaction of a cooperating die of equal but opposite lead to roll a thread on said shank in a single rolling pass of said shank between said coacting dies, the improvement wherein said die block is beveled along said edge at an angle such as to cause the crest of each emerging land to diminish gradually in height to the bottom of the groove between the emerging land and the adjacent land, and the interior flank of said diminishing land is beveled at an angle such as to maintain the parallelism of the crest of the diminishing land with the crest of said adjacent land.

2. The improved thread-rolling die of claim 1 wherein each land is symmetrical in cross section, and said bevel angles are equal.

3. The improved thread-rolling die of claim 2 wherein said bevel angles and the flank angles of the land at full height are the same angles.

4. The improved thread-rolling die of claim 2 wherein said bevel angles are 45°.

5. The improved thread-rolling die of claim 1 wherein said bevel angles are the respective flank angles of the land at full height.

6. In a die for rolling threads on a shank of circular cross section, said die comprising a block of tool material having a shank-engaging face striated with multiple grooves and lands complementary to the thread to be produced upon said shank, said grooves and lands being disposed at the thread lead angle with respect to the direction of movement of said die block relative to said shank in the rolling of the thread and emerging from the die block along an edge thereof in multiple thread starts sufficient with the coaction of a cooperating die of equal but opposite lead to roll a thread on said shank in a single rolling pass of said shank between said coacting dies, the improvement wherein said die block is beveled along said edge at an angle sufficient to cause the crest of each emerging land to diminish gradually in height to the bottom of the groove between itself and the adjacent land, the cross section of each land at full height is symmetrical about the crest of the land, and the interior flank of each diminishing land is beveled at an angle such as to maintain the symmetry of the flanks of the diminishing land about its crest.

* * * * *

UNITED STATES PATENT AND TRADEMARK OFFICE

CERTIFICATE OF CORRECTION

PATENT NO. : 5,943,904

DATED : August 31, 1999

INVENTOR(S) : Rodney M. Kramer

It is certified that error appears in the above-identified patent and that said Letters Patent is hereby corrected as shown below:

Column 1, line 3, change "relates a method and to" to --relates to a method and--.

Signed and Sealed this

Twenty-fifth Day of April, 2000

*Attest:*

Q. TODD DICKINSON

*Attesting Officer*

*Director of Patents and Trademarks*